United States Patent [19]

Parker et al.

[11] Patent Number: 4,585,204

[45] Date of Patent: Apr. 29, 1986

[54] CONCRETE FORMING SYSTEM

[76] Inventors: Lawrence A. Parker, 3233 Colgate, Dallas, Tex. 75225; James W. Keeter, 1111 Dula Cir., Duncanville, Tex. 75116; Arturo C. Robles, 1417 Bennett, Apt. D, Dallas, Tex. 75206

[21] Appl. No.: 609,831

[22] Filed: May 14, 1984

[51] Int. Cl.[4] ..... E04G 11/36

[52] U.S. Cl. ..... 249/28; 52/646; 249/27; 425/62

[58] Field of Search ..... 52/646, 650, 126.4, 52/126.6; 249/18, 24, 28, 210, 27, 29; 425/62

[56] References Cited

U.S. PATENT DOCUMENTS

| | | | |
|---|---|---|---|
| 1,958,933 | 5/1934 | Williams | 249/28 X |
| 3,826,057 | 7/1974 | Franklin | 52/641 |
| 3,847,340 | 11/1974 | Ficken et al. | 249/18 |
| 3,966,164 | 6/1976 | Dashew | 249/210 X |
| 3,977,536 | 8/1976 | Moore et al. | 249/18 X |
| 4,106,256 | 8/1978 | Cody | 52/646 |
| 4,123,032 | 10/1978 | Teschner | 249/29 |
| 4,227,672 | 10/1980 | Cunningham | 249/24 X |
| 4,470,574 | 9/1984 | Jackson | 249/219 R X |
| 4,492,358 | 1/1985 | Manderla | 249/28 X |

*Primary Examiner*—Alfred C. Perham
*Assistant Examiner*—Jean M. LaKemper
*Attorney, Agent, or Firm*—Michael A. O'Neil

[57] ABSTRACT

A concrete forming system includes telescoping jacks, bottom chords and top chords. The bottom and top chords separate the telescoping jacks into spaced, parallel rows. Diagonal struts extend between the bottom chords and the top chords within each row. Cross braces extend between corresponding telescoping jacks of adjacent rows. Joists are supported on the top chords and/or on beams supported by the telescoping jacks, and in turn support forming members. The component parts of the system may be used to make flying truss forms, flying pan forms, structural beam forms, rolling deck scaffold forms, column hung forms and wall forms.

9 Claims, 16 Drawing Figures

CONCRETE FORMING SYSTEM

TECHNICAL FIELD

This invention relates generally to concrete forming systems, and more particularly to a concrete forming system which is readily adapted to changes in building design and which incorporates components which may be utilized in a variety of concrete forming applications.

BACKGROUND AND SUMMARY OF INVENTION

At the present time a wide variety of construction techniques are utilized in the fabrication of multi-story buildings. In accordance with one widely used technique, each successive floor of the building is constructed by means of forms positioned on the next lower floor. When all of the forms necessary for the construction of at least a section of a particular floor are in place, concrete is poured onto the forms. When the concrete has cured sufficiently, the forms are removed.

In an effort to reduce both the cost and time involved in form construction, the use of so called flying forms has evolved. After the concrete of a particular floor in a multi-story building has cured, the flying forms are lowered and moved laterally out from beneath the floor. A crane is used to receive, raise, and position the flying forms. When all of the flying forms are properly located, the concrete for the next successive floor of the building is poured and allowed to cure. This procedure is then repeated until all of the floors comprising the building have been constructed.

Notwithstanding the widespread use of the flying form technique in the construction of multi-story buildings, currently available flying form systems exhibit numerous problems. For example, many of the presently available systems are not readily adapted for changeover between one building design and another. Many flying form systems employ loose leveling jacks which can fall when the forms are moved from one floor to the next, resulting in damage or injury. Presently available flying form systems often require the use of expensive accessories, which may actually be idle for long periods of time. Some flying form systems necessitate the use of air compressors and other expensive machinery which must be either rented or purchased by the contractor, thereby adding to the cost of building construction.

Another difficulty which characterizes presently available flying form systems involves the fact that the component parts thereof are not readily adapted to a variety of uses. That is, while a particular system might be readily adapted to flying form applications, the component parts of the system cannot be used in applications such as forming walls, forming floors between previously formed columns, etc. Under such circumstances the contractor is forced to purchase and use substantially duplicate components in order to complete all of the tasks that might be required in the construction of a particular building.

The present invention comprises a concrete forming system which overcomes the foregoing and other difficulties long since associated with the prior art. In accordance with the broader aspects of the invention, a concrete forming system comprises components which may be utilized in such diverse applications as flying truss forms, flying pan deck forms, rolling structural beam forms, rolling deck scaffold forms, column hung forms, and wall forms. Thus, by means of the invention it is unnecessary to purchase and use substantially duplicate components in order to fulfill the requirements of various diverse concrete forming applications.

Concrete forming systems incorporating the invention are readily adapted to changes in building design. For example, changes in truss spacing and/or chord length can be accomplished utilizing simple hand tools. Both longitudinal and transverse beam forms can be added to or removed from the basic forming system with equal ease. Concrete forming systems incorporating the invention do not include any loose parts whatsoever, thereby eliminating the danger of damage or injury when the forms are moved. The practice of the invention does not involve the use of expensive accessories or equipment, thereby leading to reduced building construction costs.

DESCRIPTION OF THE DRAWINGS

A more complete understanding of the invention may be had by the following Detailed Description when taken into conjunction with the accompanying Drawings, wherein.

DETAILED DESCRIPTION

Figure 1:
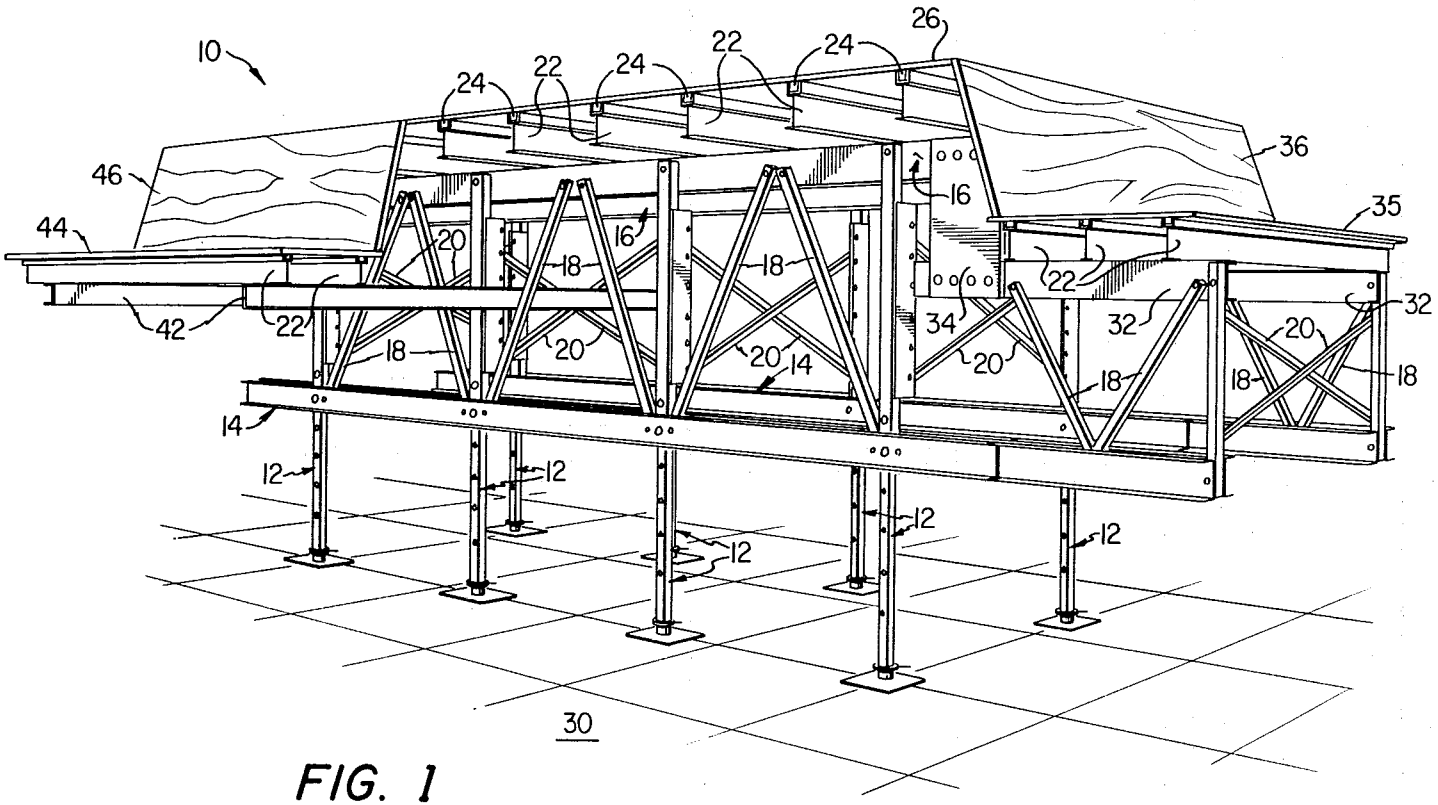
FIG. 1 is a perspective view of a concrete forming system constructed in accordance with the invention which comprises a flying truss form.

Referring now to the Drawings and particularly to FIG. 1 thereof there is shown a flying truss form 10 comprising a first embodiment of the concrete forming system of the present invention. The flying truss form 10 includes a plurality of telescoping jacks 12. The jacks 12 support bottom chords 14 and top chords 16. The bottom chords 14 and the top chords 16 separate the telescoping jacks 12 into spaced, parallel rows.

A plurality of gusset struts 18 extend between the bottom chords 14 and the top chords 16 within each row. In most instances the lower end of a particular gusset strut 18 is connected both to one of the bottom chords 14 and to one of the telescoping jacks 12, while the upper end thereof is connected to the corresponding top chord 16 at a point intermediate the positioning of the telescoping jacks 12. Telescoping cross braces 20 extend between the telescoping jacks 12 comprising the spaced, parallel rows. Each telescoping cross brace 20 has a lower end connected to a telescoping jack 12 in one of the rows and an upper end connected to the corresponding telescoping jack 12 in the next adjacent row.

A plurality of joists 22 are supported on and extend transversely between the top chords 16 comprising the spaced, parallel rows. The joists 22 are secured to the top chords 16 by means of suitable fasteners. The upper portion of each joist 22 comprises a nailing strip 24. A deck 26, which may be formed from plywood or the like, is secured to the nailing strip 24 and therefore to the joists 22 by means of nails or other, similar fasteners.

In the practice of the invention, the flying truss form 10 is positioned on a floor 30 comprising part of a building under construction. The flying truss form 10 is utilized in conjunction with other forming structure, including but not limited to other, similar flying truss forms. Reinforcing structure, for example, steel reinforcing rods, etc., is erected on top of the deck 26 and elsewhere on the forming structure in accordance with conventional practices. Wet concrete is then poured on the deck 26 and on the remaining forming structure to form the next floor of the building comprising the floor 30.

After the concrete has set, the telescoping jacks 12 are lowered to disengage the flying truss form 10 from the structure of the floor thus formed. The flying truss form 10 is then moved laterally, out of the building. A crane is used to receive, lift and position the flying truss form 10. Typically, the flying truss form 10 is utilized without major alteration in construction of a higher floor in the building.

FIG. 1 further illustrates two important features of the invention. Each top chord 16 may be provided with an extension 32 secured thereto by means of a splice plate 34. Joists 22 are supported on the extensions 32 and in turn support a panel 35 comprising an extension of the deck 26. The deck 26 further includes a section 36 extending angularly downwardly between the main portion and the panel 35 thereof. Thus, by means of the extension 32 and the component parts associated therewith, the flying truss form 10 may be utilized in the construction of beams extending transversely with respect to the bottom chords 14 and the top chords 16. It will be understood that when the flying truss form 10 is utilized in conjunction with other, similar flying truss forms, such beams may have any desired length.

Transversely extending beams 42 may be supported from the telescoping jacks 12. The beams 42 support joists 22 which in turn support a panel 44 comprising an extension of the deck 26. A section 46 extends angularly downwardly between the main portion and the panel 44 of the deck 26. Thus, the beams 42 may be utilized to form a beam extending longitudinally with respect to the bottom chords 14 and the top chords 16. It will be understood that when the flying truss form 10 is utilized in conjunction with other, similar flying truss forms, the beam which is formed by means of the beams 42 may have any desired length.

Figures 2, 2A:
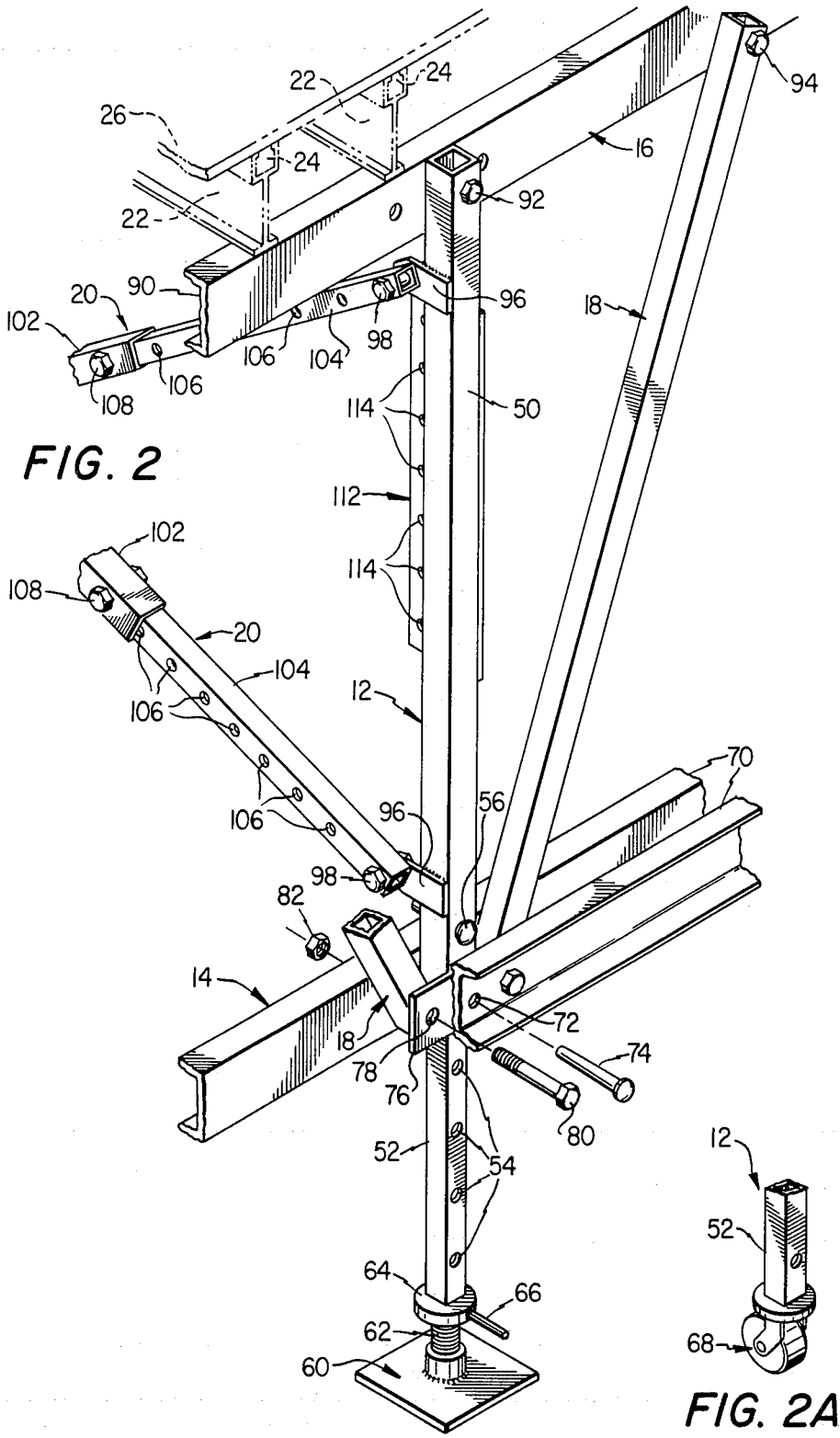
FIG. 2 is perspective view comprising an enlargement of a portion of FIG. 1.
FIG. 2A is an illustration of a variation of the apparatus shown in FIG. 2.

Referring now to FIG. 2, the construction of the component parts of the flying truss form 10 is shown in greater detail. Each telescoping jack 12 comprises an upper portion 50 having a relatively large cross sectional area and a lower portion 52 having a relatively small cross sectional area. The lower portion 52 is adapted for sliding movement into and out of the upper portion 50, and is provided with a plurality of pin receiving holes 54. A pin 56 is received through a similar pin receiving hole formed in the upper portion 50 and through a selected pin receiving hole 54 of the lower portion 52 to secure the lower portion 52 in a selected positional relationship with respect to the upper portion 50.

The telescoping jack 12 may be provided with a foot 60 mounted on the lower end of the lower portion 52 thereof. The foot 60 is secured to the lower portion 52 of the telescoping jack 12 by means of a lead screw 62 which is threadedly engaged with a fixture 64. The fixture 64 is secured to the lower end of the lower portion 52 of the telescoping jack 12 and is provided with a handle 66. The handle 66 may be utilized to rotate the fixture 64, thereby selectively extending or retracting the lead screw 62 and the foot 60 secured thereto. By this means the length of the telescoping jack may be adjusted between the limits afforded the positioning of the pin receiving holes 54.

Referring to FIG. 2A, an alternative construction for the telescoping jack 12 is shown. In certain applications of the invention, it may be considered desirable to provide the lower end of each telescoping jack 12 with a castor 68 instead of the foot 60. The castor 68 may be utilized either with or without the lead screw 62 and the fixture 64, in accordance with particular requirements.

Referring again to FIG. 2, the bottom chord 14 comprises a pair of opposed channel irons 70. The channel irons 70 are provided with pin receiving holes 72. A pin 74 is received through the pin receiving holes 72 and a similar pin receiving hole formed in the telescoping jack 12 to initially position the channel iron 70 comprising the bottom chord 14 relative to the telescoping jack 12.

A bracket 76 is welded to the lower end of the upper portion 50 of each telescoping jack 12. The bracket 76 has three holes 78 formed therethrough. The center hole 78 of each bracket 76 receives the pin 74, while the outer two holes 78 receive bolts 80 which are secured in place by nuts 82. The bolts 80 extend through bolt receiving holes formed in the channel irons 70 comprising the bottom chord 14 and through bolt receiving holes formed in the lower ends of the gusset struts 18. In this manner the channel irons 70 comprising the bottom chords 14 and the lower ends of the gusset struts 18 are secured to the telescoping jacks 12.

The top chord 16 comprises a channel iron 90 which may be identical to the channel irons 70 utilized in the bottom chord 14, if desired. Bolts 92 are received through bolt received holes formed in the upper end of the upper portion 50 of each telescoping jack 12 and in the channel iron 90 to secure the top chord 16 to the telescoping jacks 12. Similarly, bolts 94 are extended through bolt receiving holes formed in the upper end of each gusset strut 18 and through bolt receiving holes formed in the channel iron 90 to secure the upper ends of the gusset struts 18 to the top chord 16.

Brackets 96 are secured to the upper and lower ends of the upper portion 50 of each telescoping jack 12 and are utilized to secure the telescoping cross braces 20 thereto. Bolts 98 are received through bolt receiving holes formed in the telescoping cross braces 20 and through bolt receiving holes formed in the brackets 96 to secure the telescoping cross braces 20 to the telescoping jacks 12. Each telescoping cross brace 20 comprises a first portion 102 having a relatively large cross sectional area and a second portion 104 having a relatively small cross sectional area which is adapted for sliding movement into and out of the first portion 102. The second portion 104 of each telescoping cross brace 20 is provided with a plurality of bolt receiving holes 106. A bolt 108 is received through a similar bolt hole formed in the first portion 102 and through a selected bolt receiving hole 106 formed in the second portion 104 to secure the second portion 104 in a desired positional relationship with respect to the first portion 102. The use of telescoping cross braces is advantageous in that it allows the spacing between adjacent spaced, parallel rows of telescoping jacks to be quickly adjusted in accordance with the requirements of particular applications of the invention.

Each telescoping jack 12 is further provided with a bracket 112 secured to the upper portion 50 thereof. Each bracket 112 has a plurality of bolt receiving holes 114 formed therein. The function of the brackets 112 is to support beams extending transversely between telescoping jacks 12 situated in adjacent spaced, parallel rows. The selection of particular bolt receiving holes 114 to support such beams is determined by the desired positional relationship between the beams and the top chord 16.

Those skilled in the art will understand that although a flying truss form is illustrated in FIG. 1, the structure illustrated in FIGS. 1 and 2 can also be used in the construction of a flying pan form. In such instances the panels comprising the deck 26 are replaced by conventional pan forms. The pan forms are secured to the joists 22 by means of conventional fasteners. The use of the flying pan form thus constructed is substantially the same as that described in conjunction with the flying truss form 10.

Figure 3:
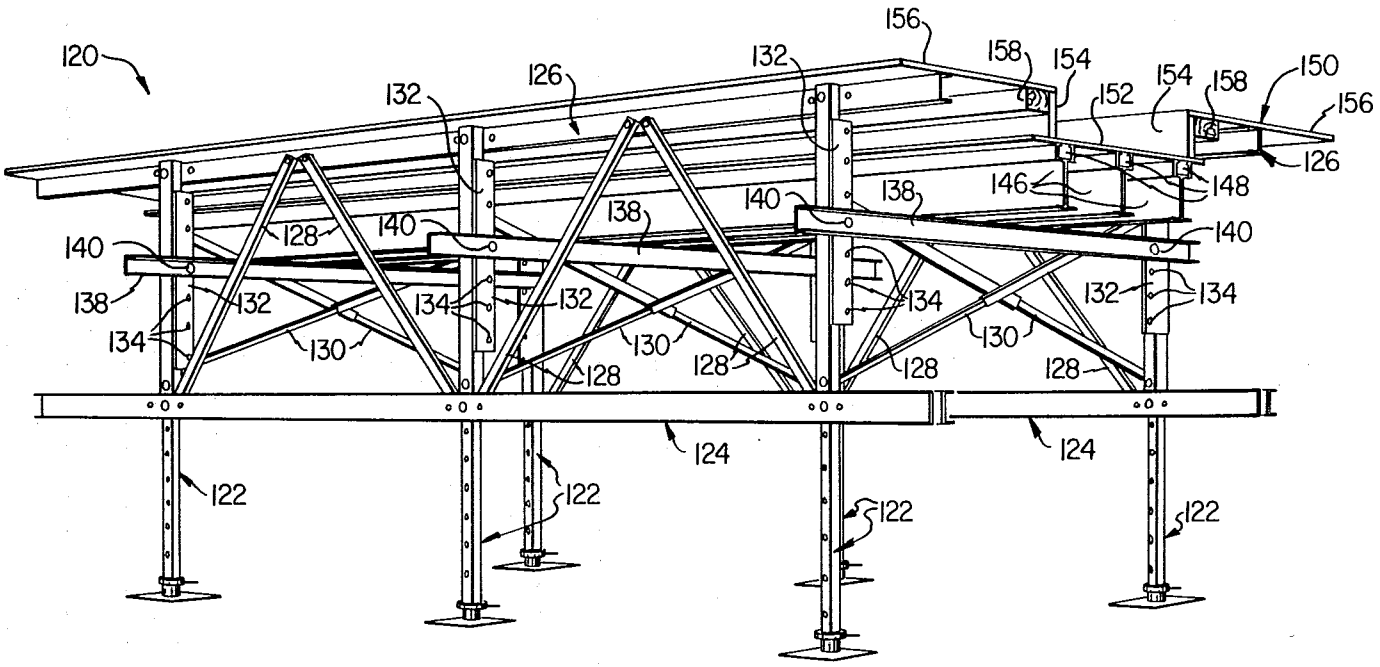
FIG. 3 is a perspective view of a concrete forming system incorporating the invention which comprises a structural beam form.

Referring now to FIG. 3, there is shown a structural beam form 120 comprising a second embodiment of the concrete forming system of the present invention. The structural beam form 120 includes a plurality of telescoping jacks 122. Bottom chords 124 and top chords 126 are supported on the telescoping jacks 122. The bottom chords 124 and the top chord 126 separate the telescoping jacks 122 into spaced, parallel rows.

Gusset struts 128 extend between the bottom chords 124 and the top chords 126 within each of the spaced, parallel rows of telescoping jacks 122. Each gusset strut 128 is connected to one of the bottom chords 124 and to one of the telescoping jacks 122 at a point adjacent the lower end thereof and is connected to the corresponding top chord 126 at a point located substantially midway between adjacent telescoping jacks 122. Telescoping cross braces 130 are connected between corresponding telescoping jacks 122 in each of the spaced, parallel rows. Each telescoping cross brace 130 is connected at one end to a point of one of the telescoping jacks 122 situated adjacent the point of connection of one of the top chords 126 thereto, and is connected at its other end to a point on the corresponding telescoping jack 122 of the opposite row at a point adjacent the point of connection of the bottom chord 124 thereto.

The telescoping jacks 122, the bottom chords 124, the top chords 126, the gusset struts 128 and the telescoping cross braces 130 comprising the structural beam form 120 are preferably constructed substantially as shown in FIG. 2. Moreover, such component parts of the structural beam form 120 are preferably interconnected substantially as shown in FIG. 2.

The telescoping jacks 122 are each provided with a bracket 132 having a plurality of bolt receiving holes 134 formed therein. Transversely extending beams 138 are supported on the telescoping jacks 122 by means of bolts 140 which are extended through appropriate bolt receiving holes 134 of the brackets 132. The transversely extending beams support joists 146 which may be of the type having nailing strips 148 secured to the upper portions thereof. A partial beam form 150 is supported on the joists 146 and includes a main panel 152 supported directly on the joists 146, side panels 154 extending substantially vertically upwardly from the outer edges of the main panel 152, and upper panels 156 extending laterally outwardly from the upper ends of the side panels 154. Beams 158 are utilized to reinforce the intersection between the side panels 154 and the upper panels 156.

The structural beam form 120 is utilized in the construction of a beam having a cross section defined by the main panel 152 and the side panels 154 of the partial beam form 150. In the practice of the invention a plurality of structural beam forms similar to the structural beam form 120 shown in FIG. 3 may be connected end to end to form a beam having any desired length. The actual construction of the beam includes the fabrication of a suitable reinforcing structure within the area defined by the main panel 152 and the side panels 154 of the partial beam form 150. After the reinforcing structure has been fabricated, the area defined by the main panel 152 and the side panels 154 and having the reinforcing structure is filled with wet concrete. After the concrete has set the structural beam form 120 may be moved to a different location for use in the construction of additional beams.

Figure 4:
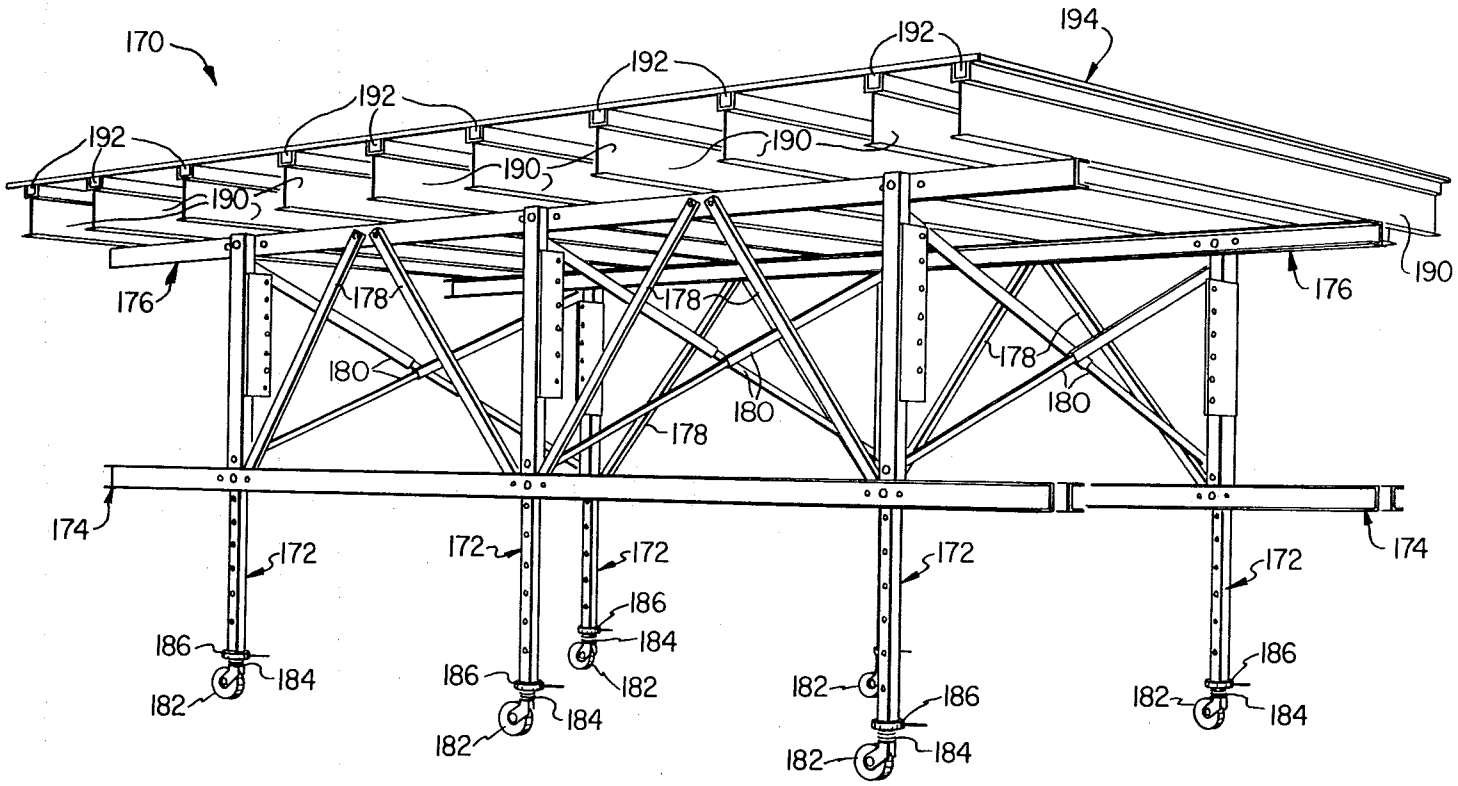
FIG. 4 is a perspective view illustrating a concrete forming system incorporating the invention which comprises a rolling deck scaffold form.

A rolling deck scaffold form 170 comprising a third embodiment of the concrete forming system of the present invention is illustrated in FIG. 4. The form 170 includes a plurality of telescoping jacks 172. The jacks 172 support bottom chords 174 and top chords 176. The bottom chords 174 and the top chords 176 separate the jacks 172 into spaced, parallel rows. Gusset struts 178 extend between the bottom chords 174 and the top chords 176 of each row. Each of the gusset struts 178 is connected at its lower end to one of the bottom chords 174 and to one of the telescoping jacks 172, and is connected at its upper end to the corresponding top chord 176. Corresponding telescoping jacks 172 of the spaced, parallel rows are interconnected by telescoping cross braces 180. Each cross brace 180 is connected at one end to one of the telescoping jacks 172 at a point adjacent the point of connection of the top chord 176 thereto, and is connected at its opposite end to the corresponding telescoping jack 172 at a point adjacent the point of connection of the bottom chord 174 thereto.

The telescoping jacks 172, the bottom chords 174, the top chords 176, the gusset struts 178, and the cross braces 180 are preferably constructed and interconnected substantially as shown in FIG. 2. Each telescoping jack 172 is supported on a castor 182 and is connected thereto by means of a lead screw 184 and a fixture 186. The use of the castor 182 facilitates the positioning of the rolling deck scaffold form 170, while the use of the lead screw 184 and the fixture 186 facilitates the precise leveling thereof.

The top chords 176 comprising the form 170 support a plurality of joists 190. The joists 190 may be of the type having nailing strips 192 at the upper ends thereof. The joists 190 support a panel 194 which may be formed from plywood or any similar material and which may be secured to the joists 190 by means of nails driven into the nailing strips 192.

The rolling deck scaffold form 170 is highly adapted to the construction of flat decks, parking lot ramps, and the like. The form 170 may be used in conjunction with a beam form of the type illustrated in FIG. 3. Other applications of the rolling deck scaffold form 170 readily suggest themselves to those skilled in the art.

In the use of the form 170, a suitable reinforcing structure is first erected on top of the panel 194. Wet concrete is then poured onto the panel 194 and onto the reinforcing structure erected thereon. After the concrete has set, the height of the form 170 is reduced to disengage the panel 194 from the set concrete. The castors 182 are then utilized to reposition the form 170 for subsequent usage.

Figure 5:
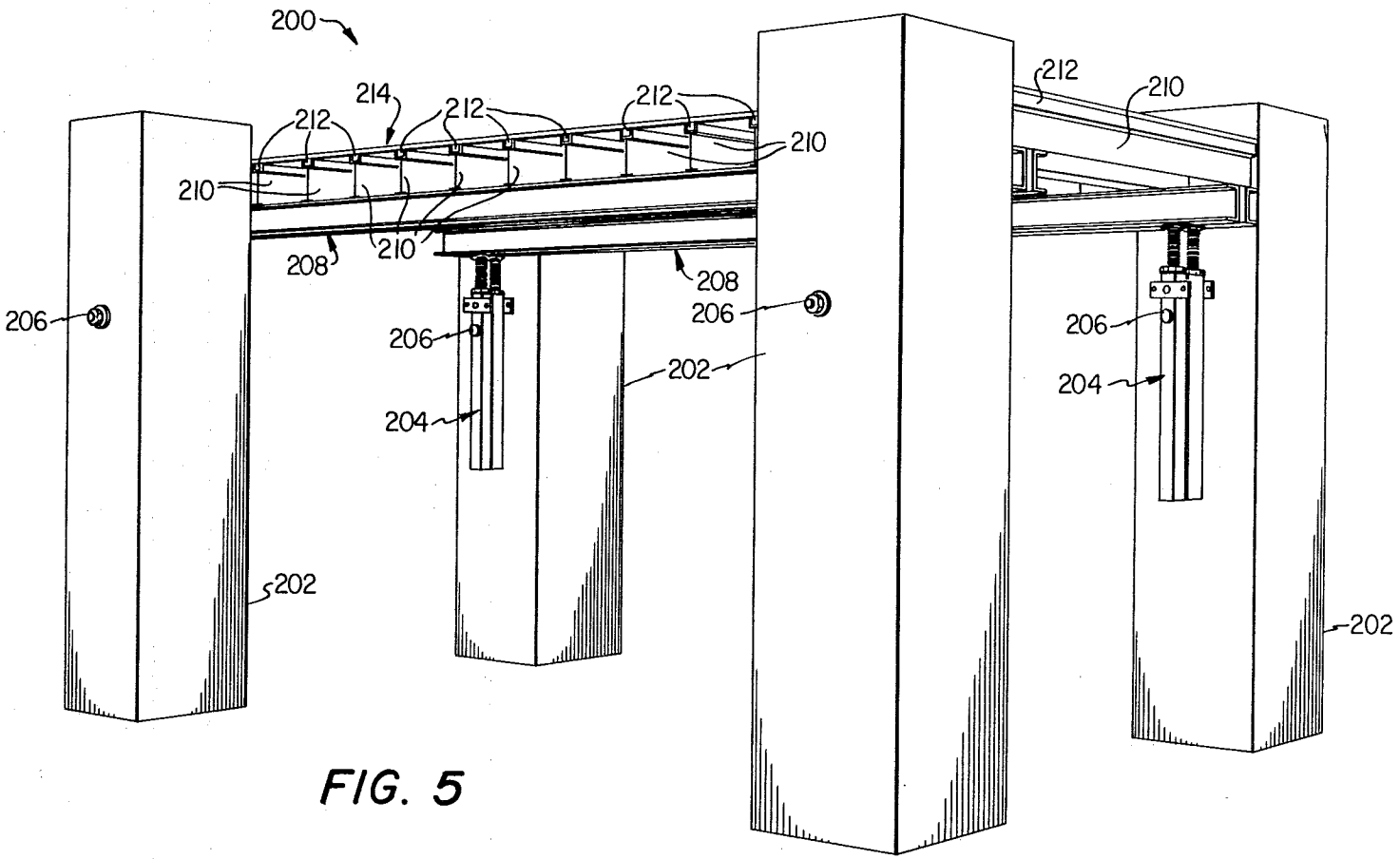
FIG. 5 is a perspective view illustrating a concrete forming system incorporating the invention which comprises a column hung form.

Referring to FIG. 5, there is shown a column hung form 200 comprising a fourth embodiment of the concrete forming system of the present invention. The form 200 is utilized in conjunction with previously constructed columns 202. In the use of the form 200, a telescoping jack 204 is secured to each column 202 by suitable means, for example, bolts 206. The telescoping jacks 204 are preferably of the type illustrated in FIG. 2. If desired, the telescoping jacks 204 may be utilized in tandem in the manner illustrated in FIG. 5.

Chords 208 are supported on the telescoping jacks 204. The chords 208 comprise opposed channel irons secured together by suitable fasteners, and are similar construction to the bottom chords 14 illustrated in FIG. 2. Joists 210 are supported on the chords 208, and are preferably of the type having nailing strips 212 at the upper ends thereof. A panel 214 is supported on the joists 210 and is secured thereto by nails or other suitable fasteners driven into the nailer strips 212.

The form 200 is adapted for use in conjunction with other, similar forms in the construction of a floor having any desired length and any desired width. After all of the forms are in place, a suitable reinforcing structure is erected on top of the panel 214. Wet concrete is then poured onto the panel 214 and over the reinforcing structure erected thereon. After the concrete has set, the form 200 is removed. The form 200 may then be secured to other columns for use in the construction of a different section of the floor, or in the construction of another floor of the building.

Figure 6:
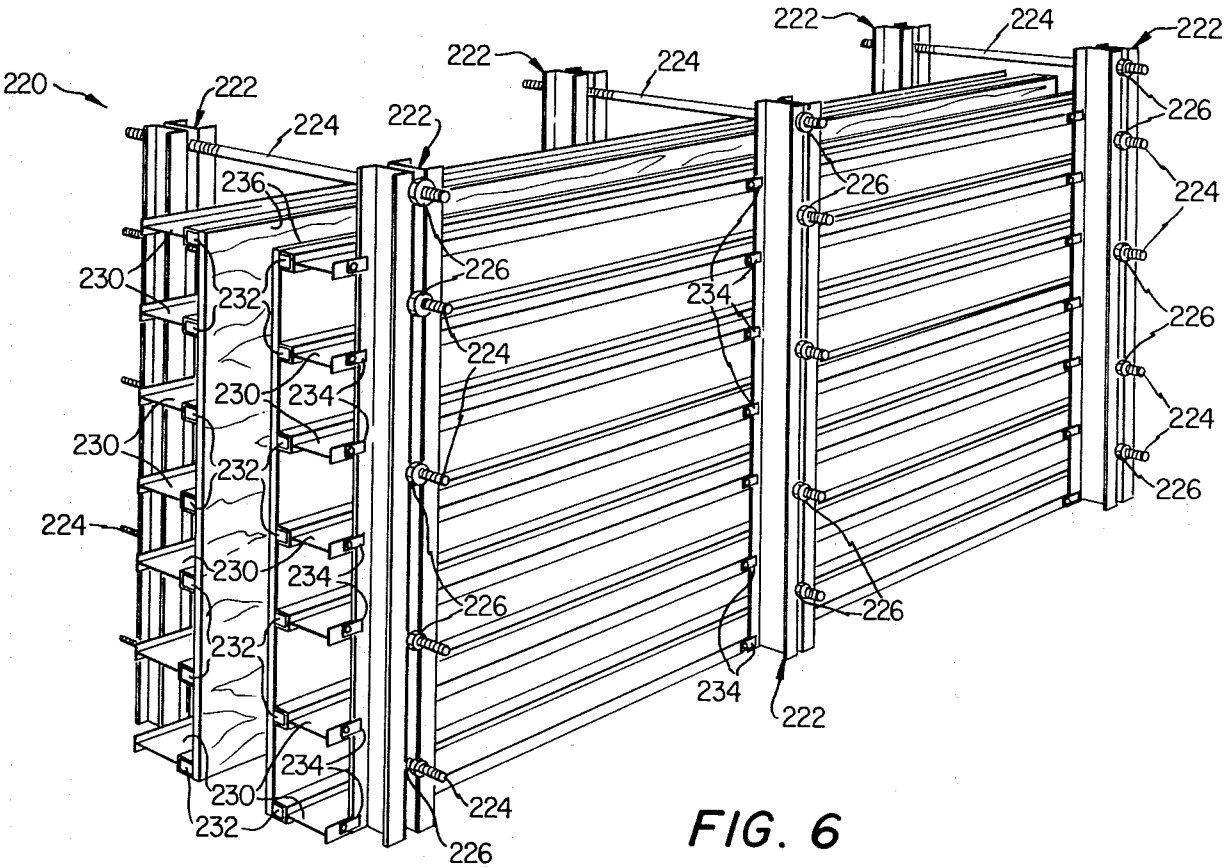
FIG. 6 is a perspective view illustrating a concrete forming system incorporating the invention which comprises a wall form.

FIG. 6 illustrates a wall form 220 comprising a fifth embodiment of the concrete forming system of the present invention. The wall form 220 incorporates a plurality of chords 222. The chords 222 comprise opposed channel irons, and are preferably constructed similarly to the bottom chords 14 shown in FIG. 2. The chords 222 are interconnected by tie rods 224, and are secured thereto by means of suitable fasteners 226.

Joists 230 are secured to the chords 222. The joists 230 are preferably of the type having nailing strips 232 mounted at the distal ends thereof. Suitable conventional fasteners 234 may be utilized to secure the joists 230 to the chords 222. Panels 236 are secured to the joists 230. The panels 236 may be formed from plywood or the like and are preferably secured to the joists 230 by means of nails or similar conventional fasteners which are driven into the nailing strips 232.

In the use of the form 220, a suitable reinforcing structure is first erected between the panels 236. The reinforcing structure may be erected either prior to or after the positioning of the panel 236 as shown in FIG. 6. Wet concrete is then poured between the panels 236 and around the reinforcing structure erected therebetween. After the concrete has set, the form 220 is disassembled and the component parts thereof are then adapted for use in the construction of other wall sections.

Figure 7:
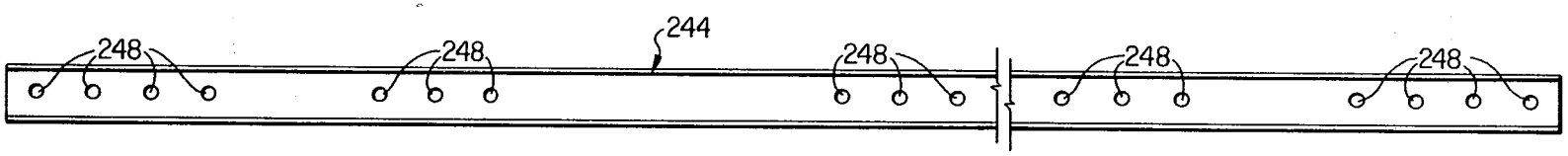
FIG. 7 is a side view of a chord member that is utilized in a flying truss form comprising a sixth embodiment of the invention.

Referring now to FIGS. 7–15, there is shown a flying truss form 240 incorporating a sixth embodiment of the invention. The flying truss form 240 comprises a plurality of top chord members 242 and a plurality of bottom chord members 244. The construction of the bottom chord members 244 is illustrated in FIG. 7, it being understood that the top chord members 242 are similar except for the length thereof which is selected in accordance with the requirements of a particular application of the invention.

Each of the chord members 242 and 244 comprises a channel iron having a plurality of fastener receiving holes 248 formed therethrough. The fastener receiving holes 248 are arranged in groups to facilitate the interconnection of the various component parts of the flying truss form 240. In the mid-region of the channel iron 246 the fastener receiving holes are preferably formed in groups of three, while the opposite ends of the channel iron 246 is preferably provided with fastener receiving holes 248 arranged in groups of four or more.

Figure 8:
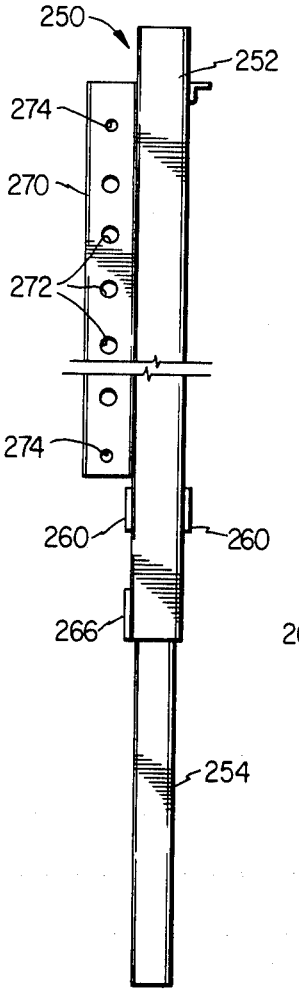
FIG. 8 is a side view of a telescoping leg utilized in the flying truss form comprising the sixth embodiment of the invention.
Figure 9:
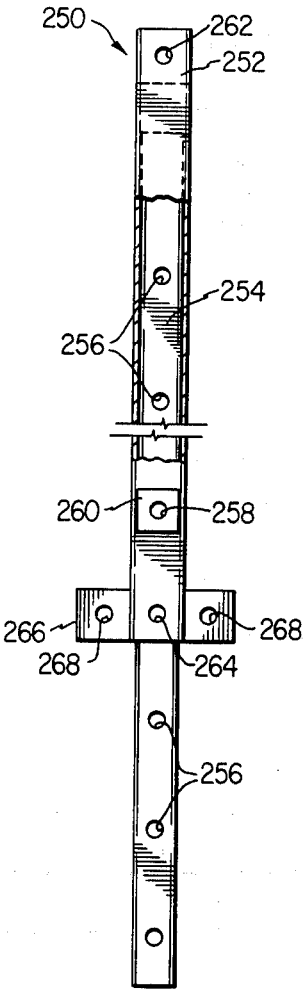
FIG. 9 is a front view of the telescoping leg of FIG. 8.

Referring to FIGS. 8 and 9, the flying truss form 240 further comprises a plurality of telescoping legs 250. Each telescoping leg 250 comprises an upper portion 252 having a relatively large cross-sectional area and a lower portion 254 having a relatively small cross-sectional area. The lower portion 254 is telescopingly received in the upper portion 252 and is provided with a plurality of fastener receiving holes 256. The upper portion 252 is likewise provided with aligned fastener receiving holes 258 which are protected by wear plates 260. It will thus be understood that the length of the telescoping leg 250 may be adjusted by first removing a fastener comprising a tapered pin from the fastener receiving holes 256 and 258, positioning the lower portion 254 in the upper portion 252 in accordance with the requirements of a particular utilization of the form 240 and then reinserting the fastener through the fastener receiving holes 258 and 256.

Each telescoping leg 250 is further provided with fastener receiving holes 262 and 264 formed in the upper and lower ends of the upper portion 252 thereof, respectively. A bracket 266 is secured to the lower end of the upper portion 252 and is provided with three fastener receiving holes 268. One of the fastener receiving holes 268 of the bracket 266 is aligned with the fastener receiving holes 264 formed through the upper portion 252 of the telescoping leg 250.

Figure 10:
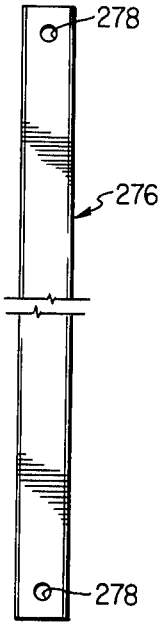
FIG. 10 is a front view of a vertical strut utilized in a flying truss form comprising the sixth embodiment of the invention.
Figure 11:
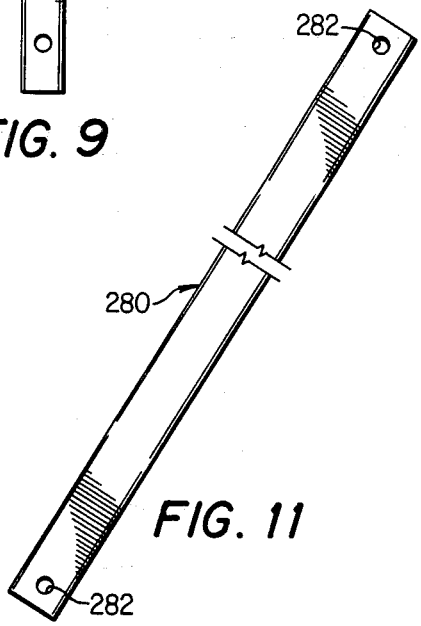
FIG. 11 is a front view of a diagonal strut utilized in the flying truss form comprising the sixth embodiment of the invention.
Figure 12:
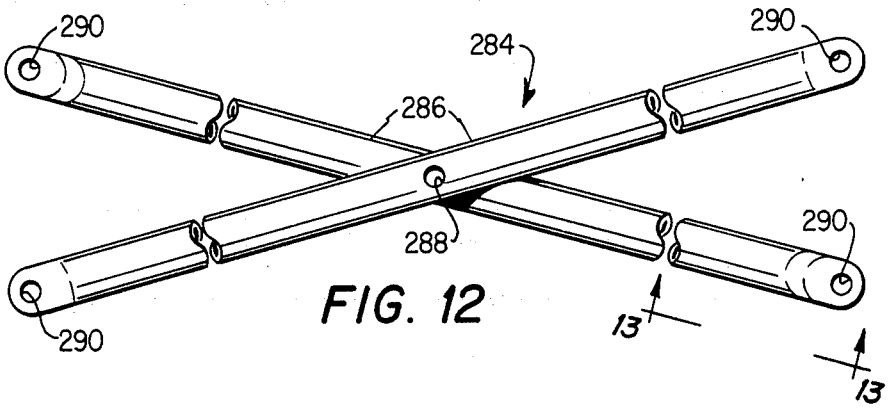
FIG. 12 is an illustration of a diagonal brace structure utilized in the flying truss form comprising a sixth embodiment of the invention.
Figure 13:
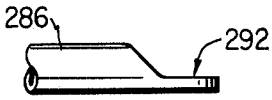
FIG. 13 is an enlarged top view of a portion of the diagonal brace structure of FIG. 12.

A bracket 270 is secured to one side of the upper portion 252 of the telescoping leg 250. The bracket 270 preferably comprises a length of square tubing which is secured to the upper portion 252 by welding. The bracket 270 has a plurality of large diameter fastener receiving holes 272 formed therethrough at spaced apart points, and also has small diameter fastener receiving holes 274 formed therethrough. The fastener receiving holes 274 are located adjacent the upper and lower ends of the bracket 270 and are utilized in securing adjacent legs 250 one to the other. In FIG. 10 there is shown a vertical strut 276 comprising a length of square tubing having fastener receiving holes 278 formed through the upper and lower ends thereof. FIG. 11 illustrates a diagonal strut 280 also comprising a length of rectangular tubing having fastener receiving holes 282 formed through the upper and lower ends thereof. In FIG. 12 there is shown an x-brace 284 comprising a pair of tubular members 286 which are pivotally interconnected at 288. Fastener receiving holes 290 are provided at the ends of each tubular member 286. As is best shown in FIG. 13, the end portion 292 of each tubular member 286 is die-formed to facilitate the connection thereof to the brackets 270 of the telescoping legs 250.

Figure 14:
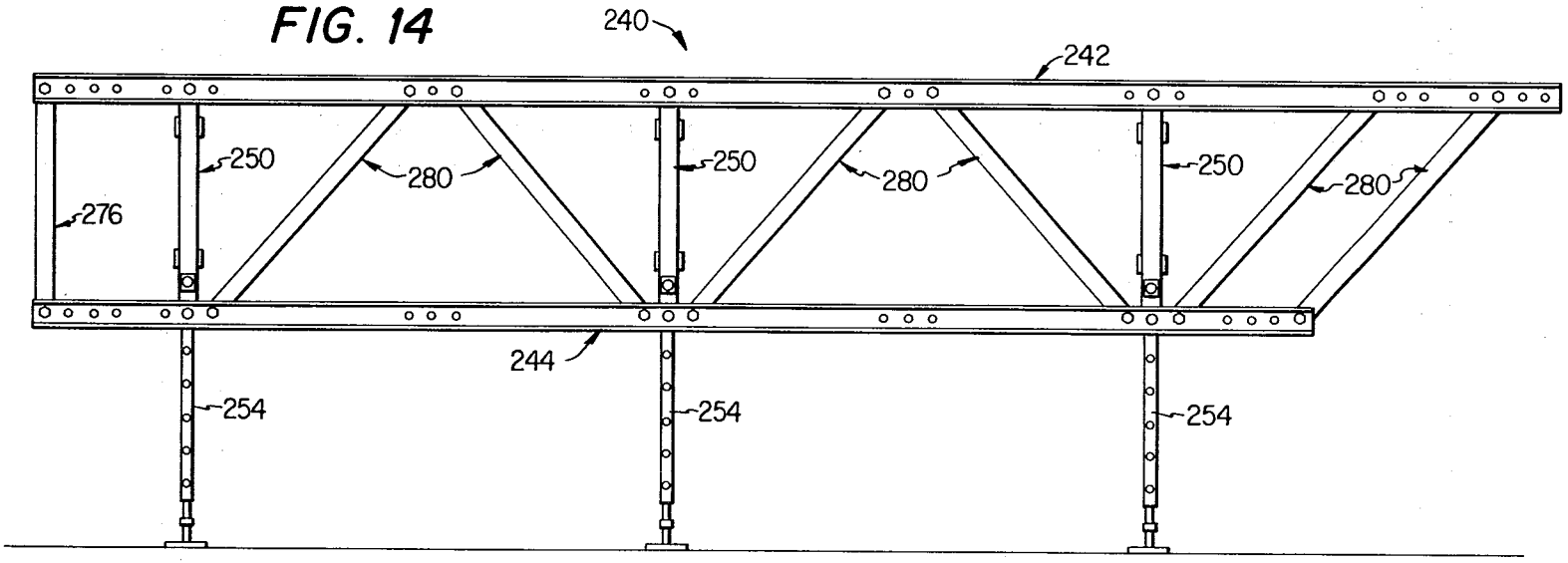
FIG. 14 is a side view of the flying truss form incorporating the sixth embodiment of the invention.
Figure 15:
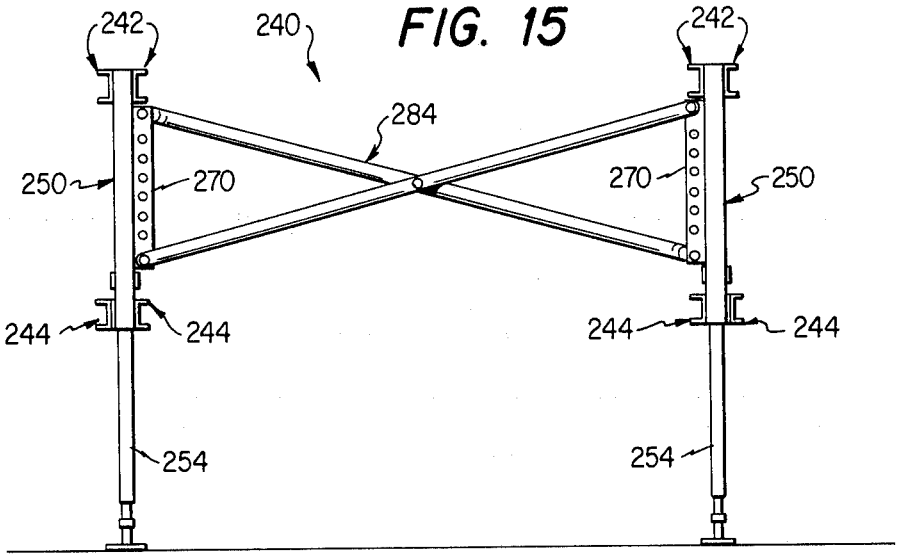
FIG. 15 is an end view of the flying truss form of FIG. 14.

The interconnection of the various component parts shown in FIGS. 7 through 13, inclusive, is illustrated in FIGS. 14 and 15. The top chords 242 and the bottom chords 244 are supported on the telescoping legs 250 by means of suitable fasteners received through appropriate fastener receiving holes 248 and through the fastener receiving holes 262 and 264. The vertical struts 276 are secured by suitable fasteners received through appropriate fastener receiving holes 248 and the fastener receiving holes 278. The diagonal struts 280 are secured in place by means of suitable fasteners received through appropriate fastener receiving holes 248, through the fastener receiving holes 268 of the brackets 266 and through the fastener receiving holes 282.

Referring particularly to FIG. 15, the top chords 242 and the bottom chords 246 separate the telescoping legs 250 into spaced apart rows. Aligned telescoping legs 250 of adjacent rows are interconnected by means of the x-braces 284. The x-braces 284 are connected to the telescoping legs 250 by means of appropriate fasteners received through the small diameter fastener receiving holes 274 of the brackets 270 and through the fastener receiving holes 290 of the x-braces 284. The large diameter receiving holes 272 of the brackets 270 are used to support transversely extending beams. In this manner the flying truss form 240 may be utilized as illustrated in FIGS. 1 and 3 to support form portions situated at various vertical elevations.

It will thus be understood that the present invention comprises a concrete forming system incorporating numerous advantages over the prior art. From the foregoing, it will be understood that the concrete forming system of the present invention utilizes numerous component parts which are common throughout the various embodiments thereof. This facilitates the use of the component parts of the system in various concrete construction applications, while eliminating the requirement of purchasing similar components for various applications as has heretofore been required. Another advantage deriving from the use of the invention involves the fact that expensive accessories and/or equipment are not required in the practice thereof. Concrete forming systems incorporating the invention do not utilize loose leveling jacks or other components, thereby eliminating the risk that such components will be dislodged during repositioning of forms incorporating the invention. Other advantages readily suggest themselves to those skilled in the art.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. In a concrete forming system, the improvement comprising:

a plurality of telescoping jacks each including:

a. an upper portion having a relatively large cross sectional area and having fastener receiving holes formed in the upper and lower ends thereof;

b. a lower portion having a relatively small cross sectional area telescopingly received in the upper portion for selective longitudinal positioning with respect thereto and having a plurality of fastener receiving holes formed therein at equally spaced intervals;

c. A leveling jack mounted on the end of the lower portion of the telescoping jack; and d. at least one fastener for selective engagement with a fastener receiving hole at the lower end of the upper portion of the telescoping jack and a selected fastener receiving hole of the lower portion of the telescoping jack to fix the positioning of the lower portion relative to the upper portion;

a pair of bottom chords extending between and interconnecting the lower ends of the upper portions of two rows of the telescoping jacks;

a pair of top chords extending between and interconnecting the upper ends of the two rows of telescoping jacks;

said bottom chords and top chords dividing the telescoping jacks into spaced, parallel rows;

a plurality of first brackets each secured to the lower end of the upper portion of one of the telescoping jacks and each having a plurality of fastener receiving holes formed therethrough;

a plurality of diagonal gusset struts each having fastener receiving holes formed through the upper and lower ends thereof;

a plurality of fasteners securing the lower ends of the diagonal gusset struts and the bottom chords to the first brackets of the telescoping jacks;

a plurality of fasteners securing the upper ends of the diagonal gusset struts to the top chords at points substantially displaced from the points of attachment of the telescoping jacks thereto;

a plurality of joists supported on top of the top chords and in turn supporting concrete forming members above the top chords;

a plurality of second brackets each fixedly secured to the upper end of the upper portion of one of the telescoping jacks in each row below the top chords thereof and each having a plurality of fastener receiving holes formed therein arranged in a predetermined vertical array;

a plurality of cross beams having fastener receiving holes formed in the opposite ends thereof;

a plurality of fasteners securing the cross beams to the second brackets at selected locations below the top chords in adjacent rows, the cross beams in turn supporting concrete forming members below the top chords;

a plurality of telescoping cross braces each comprising an elongate tubular member having fastener receiving holes formed through each end thereof; and means connecting one end of each cross brace to one of the telescoping jacks at the point adjacent the point of connection of the bottom chord thereto and for connecting the opposite end of the telescoping cross brace to a point on the corresponding telescoping jack of the opposite row at a point adjacent the point of connection of the top chord thereto.

2. The concrete forming system according to claim 1 wherein the leveling jack secured to the lower end of the lower portion of each telescoping jack comprises:

a. a fixture secured to the lower end of the telescoping jack;

b. a lead screw threadedly engaged with the fixture for selected extension or retraction with respect thereto; and means secured to the lower end of the lead screw for engagement with the underlying surface.

3. The concrete forming system according to claim 2 wherein the means secured to the lower end of the lead screw comprises a stabilizing foot.

4. The concrete forming system according to claim 2 wherein the means secured to the lower end of the lead screw comprises a roller for facilitating movement of the concrete forming system.

5. The concrete forming system according to claim 1 wherein the bottom chords each comprise a pair of channel irons secured to the opposite sides of the lower ends of the upper portions of the telescoping jacks.

6. The concrete forming system according claim 1 wherein the top chords each comprise at least one channel iron secured to the upper end of the upper portion of each telescoping jack.

7. The concrete forming system according to claim 1 further characterized by third brackets secured to the upper portion of each telescoping jack at points adjacent the upper and lower ends thereof and wherein the telescoping cross braces are secured to the telescoping jacks by means of the third brackets mounted thereon.

8. The concrete forming system according to claim 1 wherein the bottom chords and the top chords comprise substantially identical channel irons having fastener receiving holes formed therein.

9. The concrete forming system according to claim 8 wherein:

the first brackets have fastener receiving holes formed therethrough in alignment with fastener receiving holes formed in the bottom chords and bolt receiving holes formed in the lower ends of the diagonal struts, and the bottom chords and the gusset struts are secured to the telescoping jacks by means of fasteners received through the fastener receiving holes formed therein and in the first brackets;

the upper ends of the telescoping jacks and the upper ends of the diagonal struts are secured to the top chord by means of fasteners extending through fastener receiving holes formed therein and in the top chord; and the means for connecting the cross braces to the telescoping jacks comprising brackets having fastener receiving holes formed therein, the cross braces being secured to the brackets by fasteners extending through fastener receiving holes formed therein and in the brackets.

* * * * *